US010428635B2

(12) United States Patent
Ayub et al.

(10) Patent No.: US 10,428,635 B2
(45) Date of Patent: Oct. 1, 2019

(54) SYSTEM AND METHOD FOR REMOVING SAND FROM A WELLBORE

(71) Applicant: Saudi Arabian Oil Company, Dhahran (SA)

(72) Inventors: Muhammad Ayub, Dhahran (SA); Nabeel S. Habib, Safwa (SA)

(73) Assignee: SAUDI ARABIAN OIL COMPANY (SA)

( * ) Notice: Subject to any disclaimer, the term of this patent is extended or adjusted under 35 U.S.C. 154(b) by 395 days.

(21) Appl. No.: 15/370,584

(22) Filed: Dec. 6, 2016

(65) Prior Publication Data

US 2018/0156021 A1 Jun. 7, 2018

(51) Int. Cl.

| | |
|---|---|
| ***E21B 33/12*** | (2006.01) |
| ***E21B 37/00*** | (2006.01) |
| ***E21B 43/02*** | (2006.01) |
| ***E21B 43/12*** | (2006.01) |
| ***E21B 43/38*** | (2006.01) |

(52) U.S. Cl.

CPC ..... *E21B 43/38* (2013.01); *E21B 33/12* (2013.01); *E21B 37/00* (2013.01); *E21B 43/02* (2013.01); *E21B 43/121* (2013.01)

(58) Field of Classification Search

CPC ..... E21B 33/12; E21B 37/00; E21B 43/02; E21B 43/121; E21B 43/38

See application file for complete search history.

(56) References Cited

U.S. PATENT DOCUMENTS

| | | | | |
|---|---|---|---|---|
| 1,476,747 A * | 12/1923 | Wolever | ..... | E21B 37/00 166/104 |
| 1,554,691 A | 5/1924 | Reardon | | |
| 1,547,285 A | 6/1924 | Armstrong | | |
| 2,213,987 A | 2/1937 | Layne | | |
| 3,289,608 A * | 12/1966 | Laval, Jr. | ..... | E21B 43/38 166/105.1 |
| 3,963,073 A | 6/1976 | Laval, Jr. | | |

(Continued)

FOREIGN PATENT DOCUMENTS

| | | |
|---|---|---|
| CN | 205422676 U | 8/2016 |
| EP | 0165223 A1 | 12/1985 |
| GB | 2365046 A | 2/2002 |

OTHER PUBLICATIONS

"Down Hole Separators (DHS)", A brochure published by LAKOS Separators and Filtration Solution, www.lakos.com.

(Continued)

*Primary Examiner* — Daniel P Stephenson
(74) *Attorney, Agent, or Firm* — Bracewell LLP; Constance G. Rhebergen

(57) ABSTRACT

A system and method of removing sand from a wellbore by mixing the sand with a liquid to form a slurry, and forcing the slurry through a discharge line to surface. The sand is separated from the production fluid within the wellbore by centrifugal action created using a specially design screen or tangential perforations, and directed into a portion of the wellbore that is sealed from the remainder of the wellbore. The liquid and sand are mixed together in the sealed portion of the wellbore, and the pressure of the fluid is sufficient to force the slurry uphole. Included in the sealed portion of the wellbore is a perturbation element for mixing the sand and liquid.

20 Claims, 8 Drawing Sheets

(56) References Cited

U.S. PATENT DOCUMENTS

| | | | | |
|---|---|---|---|---|
| 4,072,481 | A * | 2/1978 | Laval, Jr. | B01D 19/0057 55/459.1 |
| 4,148,735 | A * | 4/1979 | Laval, Jr. | E21B 43/38 166/105.1 |
| 4,392,529 | A * | 7/1983 | Burwell | E21B 37/00 166/311 |
| 5,033,545 | A * | 7/1991 | Sudol | B08B 9/035 134/167 C |
| 5,209,293 | A | 5/1993 | McNaughton | |
| 5,447,200 | A | 9/1995 | Dedora | |
| 6,015,011 | A * | 1/2000 | Hunter | E21B 43/08 166/227 |
| 6,119,870 | A | 9/2000 | Maciejewski et al. | |
| 6,167,960 | B1 | 1/2001 | Moya | |
| 6,189,613 | B1 | 2/2001 | Chachula et al. | |
| 6,216,788 | B1 * | 4/2001 | Wilson | E21B 37/00 166/105.1 |
| 6,371,206 | B1 * | 4/2002 | Mills | E21B 43/121 166/105 |
| 6,619,390 | B1 | 9/2003 | Kellett, III | |
| 7,905,291 | B2 | 3/2011 | Kotsonis | |
| 7,909,092 | B2 | 3/2011 | Cobb et al. | |
| 8,079,753 | B2 | 12/2011 | Sebree | |
| 8,844,614 | B2 | 9/2014 | Brown | |
| 9,045,980 | B1 | 6/2015 | Botts | |
| 9,273,539 | B2 | 3/2016 | Raglin | |
| 9,359,879 | B2 * | 6/2016 | Gill | E21B 43/38 |
| 2006/0118303 | A1 | 6/2006 | Schultz | |
| 2006/0231257 | A1 | 10/2006 | Reed | |
| 2009/0078422 | A1 | 3/2009 | Manson | |
| 2009/0173501 | A1 * | 7/2009 | Kotsonis | E21B 37/00 166/311 |
| 2010/0175869 | A1 | 7/2010 | Cobb | |
| 2013/0032352 | A1 | 2/2013 | Raglin | |
| 2013/0037264 | A1 * | 2/2013 | Brown | E21B 43/119 166/265 |
| 2015/0226046 | A1 | 8/2015 | Wolf | |
| 2016/0251951 | A1 | 9/2016 | Stachowiak et al. | |
| 2018/0156021 | A1 * | 6/2018 | Ayub | E21B 43/38 |

OTHER PUBLICATIONS

Selfridge, F., Munday, M., Kvernvold, O. and Gordon, B.: "Safely Improving Production Performance Through Improved Sand Management", SPE 83979, paper presented at Offshore Europe 2003, Aberdeen, UK, Sep. 2-5, 2003.

Andrews, G. J., Kjørholt, H. and Jøranson, H.: "Production Enhancement from Sand Management Philosophy—A Case Study from Statfjord and Gullfaks", SPE 94511, paper presented at the SPE 6th European Formation Damage Conference, Scheveningen, The Netherlands, May 25-27, 2005.

Lidwin, S. E., Yaakub, M. Y. B. and Harun, H. E. B.: "Novel Approach in Sand Production Management—Produce It!", IPTC 16454, paper presented at the International Petroleum Technology Conference, Beijing, China, Mar. 26-28, 2013.

Ogunsina, O. O.: "A Review of Downhole Separation Technology", SPE 94276, paper presented at the 2005 SPE Production and Operations Symposium, Oklahoma City, OK, USA, Apr. 17-19, 2005.

Wang, Y. and Chen, C. C.: "Enhanced Oil Production Owing to Sand Flow in Conventional and Heavy-Oil Reservoirs", SPE Reservoir Evaluation & Engineering, pp. 366-374, Oct. 2001.

Dusseault, M. B. and El-Sayed, S.: "Heavy-Oil Production Enhancement by Encouraging Sand Production", SPE 59276, paper presented at the 2000 SPE/DOE Improved Oil Recovery Symposium, Tulsa, Oklahoma, USA, Apr. 3-5, 2000.

Geilikman, M. B., Dusaeault, M. B. and Dullien, F. A.: "Fluid Production Enhancement by Exploiting Sand Production", SPE/DOE 27797, paper presented at 9th SPE/DOE Improved Oil Recovery Symposium, Tulsa, Oklahoma, USA, Apr. 17-20, 1994.

Penberthy Jr., W.L. and Shaughnessy, C.M.: "Sand Control", SPE Series on Special Topics—vol. 1, Society of Petroleum Engineers, Richardson, TX 1992 (book—no copy provided).

International Search Report and Written Opinion for related PCT application PCT/US2017/064865 dated Mar. 1, 2018.

International Search Report and Written Opinion for related PCT application PCT/US2018/054589 dated Feb. 1, 2019.

* cited by examiner

SYSTEM AND METHOD FOR REMOVING SAND FROM A WELLBORE

BACKGROUND OF THE INVENTION

1. Field of Invention

The present disclosure relates to removing sand from a wellbore by forming a slurry of sand collected at a wellbore bottom and a liquid, and forcing the slurry to surface. More specifically, the present disclosure relates to a system and methodology of separating and removing sand from a wellbore and its application to various artificial lift systems.

2. Description of Prior Art

Hydrocarbon producing wellbores extend subsurface and intersect subterranean formations where hydrocarbons are trapped. The wellbores are created by drill bits that are on the end of a drill string, where typically a top drive or rotary table above the opening to the wellbore rotates the drill string and attached bit. When hydrocarbons flow from the formation into the wellbore, other substances often accompany the hydrocarbons, such as water, hydrogen sulfide, and sand.

Excessive sand production is very common from unconsolidated, poorly cemented and relatively young geological formations. Moreover consolidated formations, in many regions of the world, are not completely free from this problem; they also release sand, though may not be excessively high in volume. Formation sand production sometimes plugs wells, erodes downhole equipment, artificial lift systems, wellhead assemblies and/or the surface facilities; which reduces productivity and damages downhole and surface equipment.

Sand can also result from proppant, which is occasionally injected into hydraulically generated fractures in rocks around wellbores. Not all of the sand remains in the fractures; but instead sometimes flows back into the wellbore and creates the above mentioned problems. Some known methods of controlling sand production include sand screens, slotted liners, gravel-pack schemes, and near wellbore sand consolidation techniques with various chemicals. However sand control techniques often reduce overall flow capacity of formation fluids towards the wellbores.

SUMMARY OF THE INVENTION

Disclosed herein is an example of a system for producing from a wellbore that includes production tubing in the wellbore having an inlet in fluid communication with a formation that is intersected by the wellbore, a seal in the wellbore that defines a sealed space, a discharge chute that is in communication with a source of sand, that that has an exit disposed in the sealed space, an inlet line in communication with a source of fluid and having a fluid exit in the sealed space, and a discharge line having an inlet in the sealed space, so that when fluid from the source of fluid flows out of the fluid exit and into the sealed space, sand from the source of sand in the sealed space mixes with the fluid exiting the fluid exit and is forced into the inlet of the discharge line. The source of sand can be from a separator coupled with the production tubing, and that is made of a housing connected to the discharge chute, inlet ports formed in a sidewall of the housing. This example can further include a one way valve on an end of the discharge chute distal from the housing which is in an open configuration when pressure in the discharge chute is greater than pressure in the sealed space, and which is in a closed configuration when pressure in the sealed space is greater than pressure in the discharge chute. In one example the system further includes a perturbation element disposed in the sealed space for mixing the sand and the fluid. In an embodiment, the perturbation element mounts to the inlet line, and which includes a base that selectively rotates and that is in fluid communication with the inlet line, vanes formed on the base, and blades mounted to the base, so that when fluid from the inlet line flows across the base, interaction of the fluid with the vanes causes the base and blades to rotate, thereby mixing the sand with the fluid to create a slurry. The system can also optionally further include a wellhead assembly mounted at an opening of the wellbore on the Earth's surface. In this example the inlet line and discharge lines can be routed through the wellhead assembly. The wellbore can include a main bore, and a lateral bore is oriented oblique to the main bore, and that intersects the main bore on a side of the seal opposite from the sealed space, and wherein the lateral bore is the source of the sand. Perforations can be formed in the formation and that are tangential to sidewalls of the wellbore, and wherein the formation is the source of the sand. The seal can include a lower seal, in this example the system further includes an upper seal in the wellbore spaced axially away from the lower seal and on a side opposite from the sealed space, and wherein a production space is defined in a portion of the wellbore between the upper and lower seals.

Also described herein is an example of a system for producing from a wellbore that includes a means for transporting connate fluid from within the wellbore that is produced from a formation intersected by the wellbore, a means for forming a slurry of motive fluid and sand separated from the connate fluid, and a means for transporting the slurry out of the wellbore. The means for transporting connate fluid from the wellbore can optionally be production tubing, and the means for separating sand from the connate fluid can be a separator that attaches to the production tubing. The means for mixing the sand with a motive fluid can be a selectively rotatable perturbation element. In this example the perturbation element is selectively rotated by contacting the perturbation element with the motive fluid. In one example the means for transporting the slurry out of the wellbore is a source of the motive fluid, an inlet line in the wellbore having an inlet in fluid communication with a source of the motive fluid and a fluid exit proximate a sealed space in the wellbore where sand separated from the connate fluid is collected, and a discharge line having an inlet in fluid communication with the slurry in the sealed space, and an exit that is disposed outside of the wellbore, and wherein the source of the motive fluid is at a pressure sufficient to lift the slurry from the sealed space and to outside of the wellbore. The system can further include a means for separating the sand from the connate fluid.

Also described herein is a method of producing from a wellbore and that includes transporting connate fluid from the wellbore that is produced from a production zone that surrounds a portion of the wellbore and lifting particulate matter separated from the connate fluid to outside of the wellbore, and separately from the connate fluid. The step of lifting particulate matter to outside of the wellbore can involve providing a motive fluid into the wellbore, forming a slurry with the particulate matter and motive fluid, wherein a pressure of the motive fluid is sufficient to lift the slurry to outside of the wellbore. Optionally the slurry is mixed in a sealed space in the wellbore and separate from where connate fluid enters the wellbore from the production zone. In one example the motive fluid rotates a perturbation element for forming the slurry.

BRIEF DESCRIPTION OF DRAWINGS

Some of the features and benefits of the present invention having been stated, others will become apparent as the description proceeds when taken in conjunction with the accompanying drawings, in which.

Figure 1:
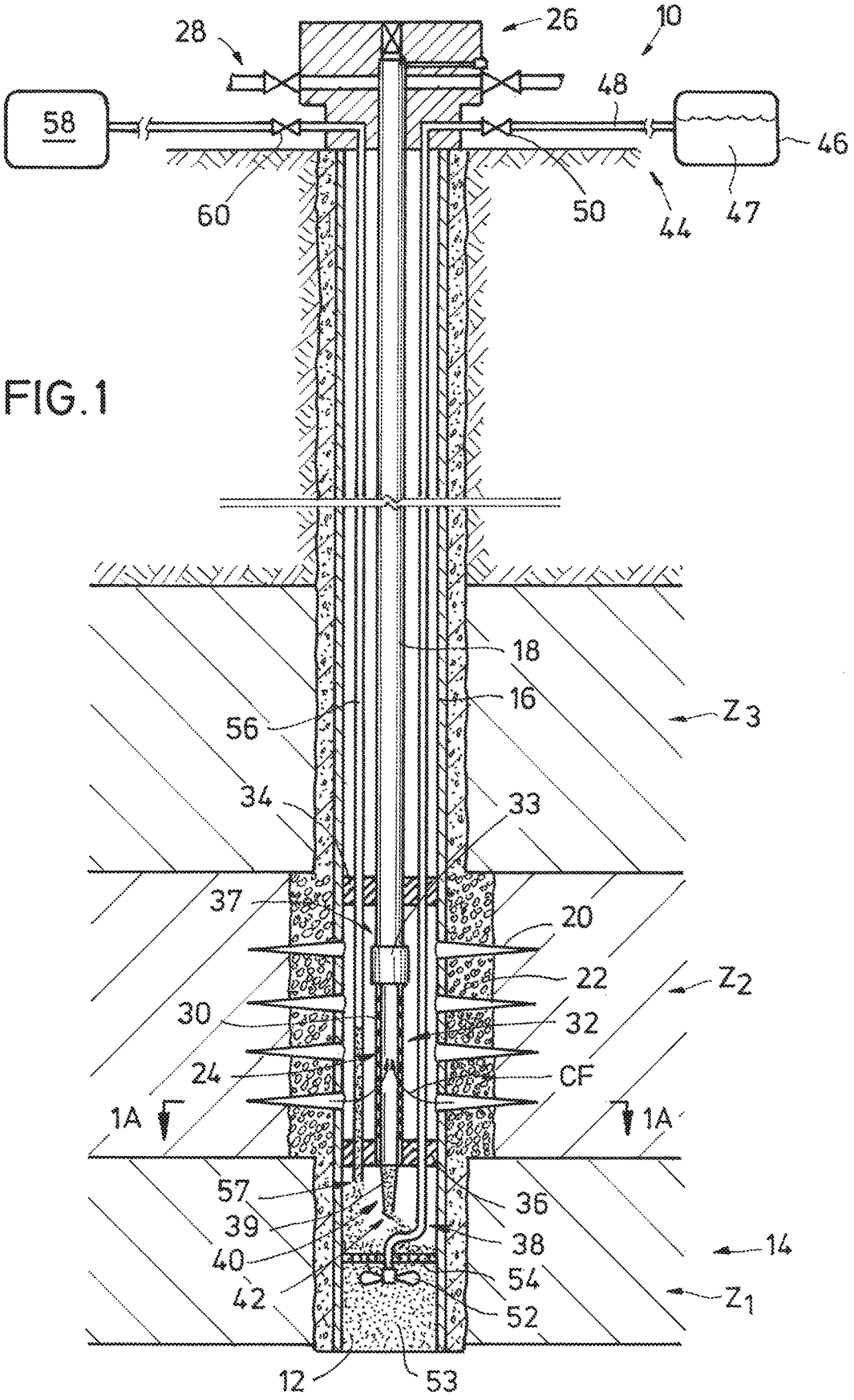
FIG. 1 is a side partial sectional view of an example of a wellbore production system for producing formation fluids from a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

An example of a wellbore production system 10 is shown in a side partial sectional view in FIG. 1. Here, connate fluid is being transported from a wellbore 12 with the wellbore production system 10. The wellbore 12 intersects a subterranean formation 14 showing having zones $Z_1$-$Z_3$ within the formation 14. A tubular casing 16 lines the wellbore 12, and production tubing 18 is inserted within the casing 16. Perforations 20 are shown extending through casing 16 and into the zone $Z_2$ so that connate fluid within zone $Z_2$ may be produced from zone $Z_2$ and flow into wellbore 12. Connate fluid can include liquid hydrocarbon, vapor hydrocarbon, water, other fluids, and combinations of these. Perforations 20 are not limited to zone $Z_2$, but instead can be formed at any depth within wellbore 12. Optionally, a gravel pack 22 circumscribes wellbore 12 adjacent where it intersects zone $Z_2$, and which is shown intersected by perforations 20. To remove particulate matter entrained within the connate fluid, such as sand or proppant, a separator 24 is shown mounted to production tubing 18. An example of the flow of connate fluid CF is illustrated as an arrow representing its flow from formation 14, through perforation 20, into wellbore 12, and into separator 24. The connate fluid, after having particles removed within separator 24, flows into tubing 18 and is then directed to a wellhead assembly 26 shown in the opening of wellbore 12 and on the earth's surface. In the illustrated example, production lines 28 mount to wellhead assembly 26 and are used for transporting the produced connate fluid to storage and/or processing facilities.

One example of a separator 24 for use in the described process can be obtained from Lakos, 1365 North Clovis Avenue, Fresno, Calif. 93727, www.lakos.com. As shown, separator 24 includes an elongate housing 30 having a cylindrical outer surface, and inlet ports 32 formed through sidewalls of the housing 30. An optional screen hanger 33 is depicted on an upper end of housing 30 for mounting the housing 30 to the lower end of production tubing 18 and within wellbore 12. An example of a packer 34 is shown provided in wellbore 12 and oriented substantially transverse to production tubing 18. Packer 34 provides a barrier to pressure and flow in axial in direction to fluid within wellbore 12, and in the annular space between separator 24 and inner surface of casing 16. Spaced axially from packer 34 is packer 36, which also provides a flow and pressure barrier within wellbore 12 in the annular space between separator 24 and inner surface of casing 16. Between packers 34, 36 a production space 37 is defined. Production space 37 is optionally roughly the same axial length of where wellbore 12 intersects with zone $Z_2$. A sealed space 38 is defined in the portion of wellbore 12 on a side of packer 36 opposite from production space 37. Thus, packer 36 blocks flow and pressure communication between production space 37 and sealed space 38.

Still referring to FIG. 1, sand 39, which has been separated from the connate fluid, is shown collected in a discharge chute 40 that mounts on an end of housing 30 distal from screen hanger 33. Discharge chute 40 is shown is an annular member and protruding into sealed space 38. While packer 36 defines a pressure and flow barrier in the annulus between separator 24 and casing 26 and between spaces 37, 38, communication between separator 24 and sealed space 38 can take place axially through discharge chute 40. A one way discharge valve 42 mounts to a lower terminal end of discharge chute 40, and which selectively discharges sand 39 from separator 24 into sealed space 38. In one example of operation, sand 39 flows from separator 24 into sealed space 38 when pressure within discharge chute 40 exceeds that of sealed space 38. A one way function of the discharge valve 42 operates such that in conditions when pressure in sealed space 38 may be close to or exceed that of pressure within discharge chute 40, discharge valve 42 moves into a closed position thereby blocking communication from sealed space 38 and back into separator 24.

Sand 39 collected within the sealed space 38 is removed from wellbore 12 by use of a sand removal system 44. Sand removal system 44 includes a fluid source 46, which can be a storage tank, a pump, or any other device for delivering fluid to within wellbore 12. In an example, the fluid includes water and which is pressurized to an amount so that when injected into wellbore 12 has sufficient inlet pressure to overcome dynamic pressure losses and frictional losses so that the fluid can then be lifted by its own pressure back out of wellbore 12. In one embodiment, the fluid defines a motive fluid for providing a motive force to carry the sand 39 from the wellbore 12. An inlet line 48 is shown connected to fluid source 46 and provides a conduit for transporting the motive fluid 47 from within fluid source 46 and into wellbore 12. Optionally, a valve 50 is shown provided within inlet line 48 for selectively controlling flow through line 48. In the illustrated example, inlet line 48 passes through a portion of wellhead assembly 26 before making its way into wellbore 12. An inlet of the inlet line 48 is in communication with fluid source 46, an exit of inlet line 48 is disposed within the sealed space 38 and discharges motive fluid into sealed space for mixing with sand 39.

A perturbation element 52 is shown disposed within wellbore 12 and which provides a mechanical means for mixing the motive fluid 47 with sand 39 to create slurry 53. An optional centralizer 54 is shown for centering perturbation element 52 within wellbore 12; and that couples to inlet line 38, or a portion of perturbation element 52. As discussed above, pressure within motive fluid 46 is imparted to slurry 53 so that slurry 53 can be flowed to a discharge line 56 that has an inlet 57 that depends into sealed space 38. As shown, inlet line 48 and discharge line 56 each penetrate packer 34 and packer 36, and wherein packers 34, 36 sealingly circumscribe lines 48, 56. An outlet end of discharge line 56 is shown connected to a storage tank 58 that is outside of wellbore 12; and which can receive the slurry 53 lifted out of wellbore 12 by the pressure within motive fluid 47. An optional valve 60 is shown in line with discharge line 56 for selectively blocking flow through discharge line 56. An advantage of the wellbore production system 10 described herein is that removing sand from the connate fluid CF does not impede fluid flow, thus production of connate fluid CF from the formation 14 and to the wellhead assembly 26 is not reduced by implementation of the separator 24 or sand removal system 44. In one non-limiting example of operation, sand production from the formation 14 is encouraged from the formation 14; which could prove to be beneficial to increase hydrocarbon production from relatively tight reservoir zone Z2 as the removed sand grains from deeper sections of Z2 could open the additional flow paths for hydrocarbons to flow easily towards wellbore 12.

Figure 2:
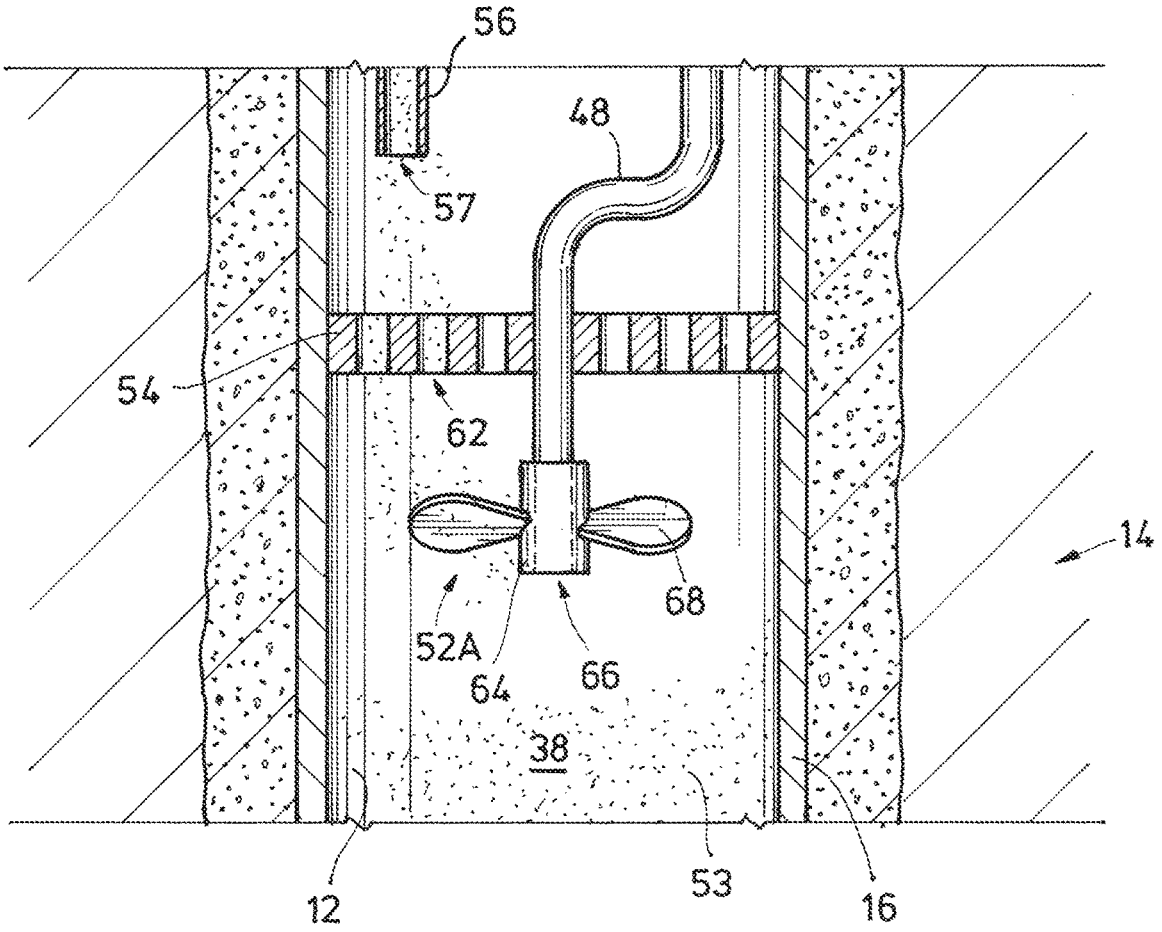
FIG. 2 is a side partial sectional view of an example of a portion of the wellbore production system of FIG. 1 and having a perturbation element.

Referring now to FIG. 2, shown in a side partial sectional view is one alternate example of a perturbation element 52A disposed in the sealed space 38 of wellbore 12. Here, centralizer 54 is shown having various openings 62 to allow the slurry 53 to make its way from within sealed space 38 and to the inlet 57 of discharge line 56. Further, perturbation element 52A is depicted as including a base 64, which is a generally annular member and rotatingly couples to a lower terminal end of inlet line 48. A fluid exit 66 on an end of base 64 opposite from its connection to inlet line 48 provides a discharge of motive fluid into the sealed space 38, where motive fluid mixes with sand 39 (FIG. 1) to form slurry 53. Blades 68 are shown coupled to an outer surface of base 64 and which rotate with rotation of base 64 to provide additional mixing of sane 39 with motive fluid to create slurry 53.

Figure 2A:
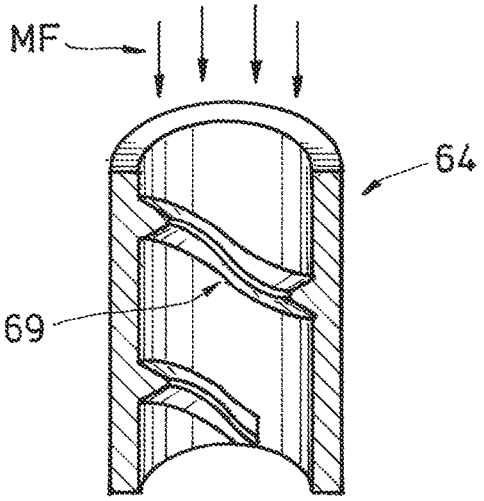
FIG. 2A is a side sectional view of a base of the perturbation element of FIG. 2.

An example of base 64 is illustrated in a cross sectional view in FIG. 2A, and where vanes 69 are provided on the inner surface of base 64. Optionally, any other type of profile or aerofoil type projection can be provided on the inner surface of base 64. Then when motive fluid MF flows through base 64 and across vanes 69, interaction between motive fluid MF and vanes 69 generates a tangential force that is exerted against base 64, which rotates base 64 and blades 68 to mix sand 39 and motive fluid MF to form slurry 53. Other types of projections can be used within base 64, which include propellers and the like, so that base 64 rotates when motive fluid MF is directed through the axial bore in base 64.

Figure 1A:
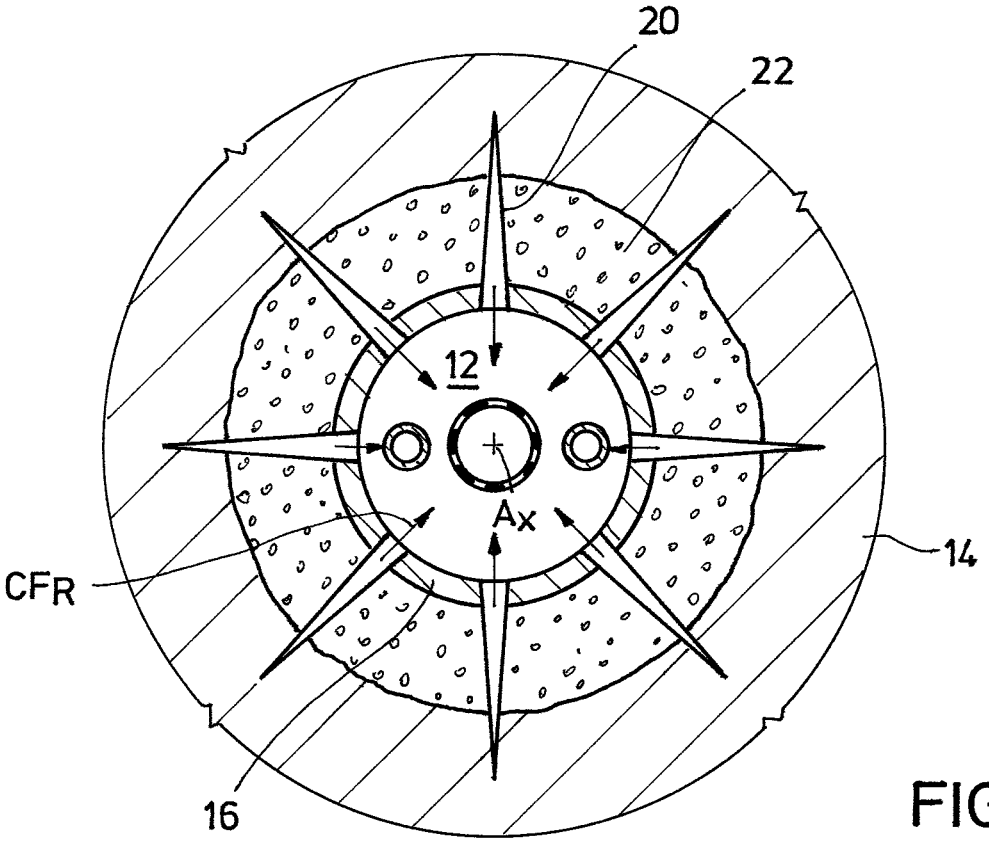
FIG. 1A is an axial sectional view of a portion of the wellbore of FIG. 1 and taken along lines 1A-1A.

FIG. 1A shows an axial sectional view of a portion of wellbore 12 and taken along lines 1A-1A of FIG. 1. Here, perforations 20 are shown as projecting substantially radially from an axis $A_X$ of wellbore 12 and through casing 16, gravel pack 22, and into formation 14. As such, the flow of connate fluid $CF_R$ from formation 14 projects radially into wellbore 12 and towards the axis $A_X$ of wellbore 12.

Figure 3A:
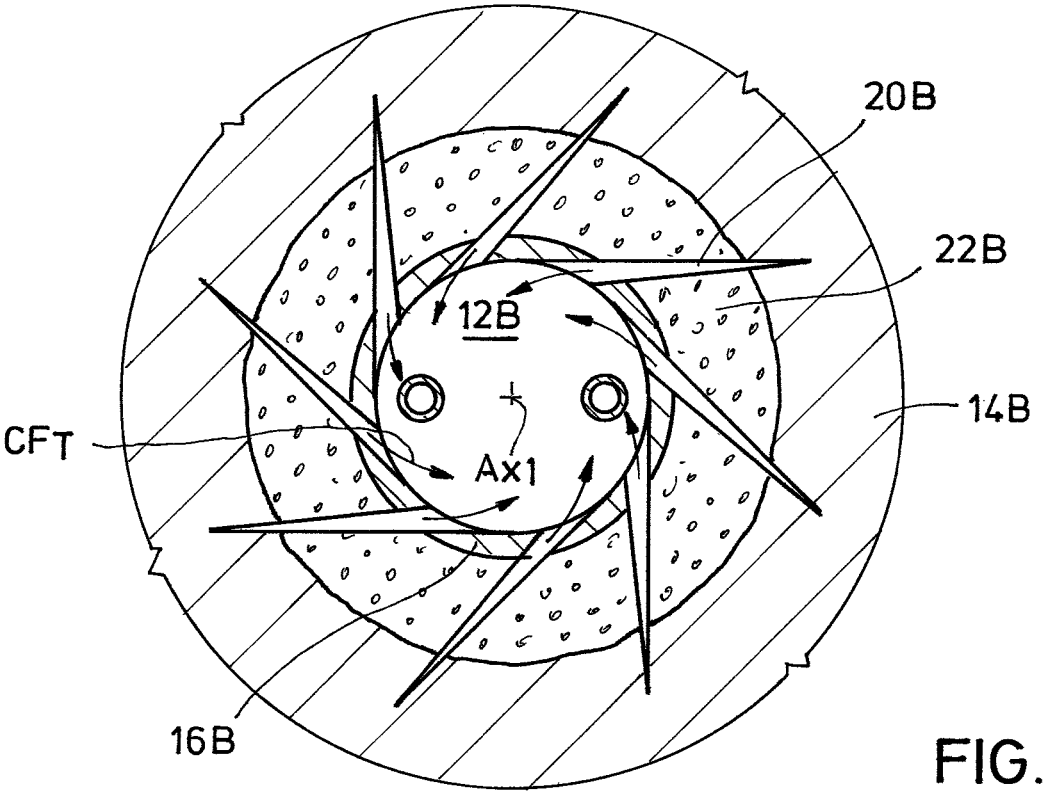
FIG. 3A is an axial sectional view of the wellbore of FIG. 3 and taken along lines 3A-3A.
Figure 3:
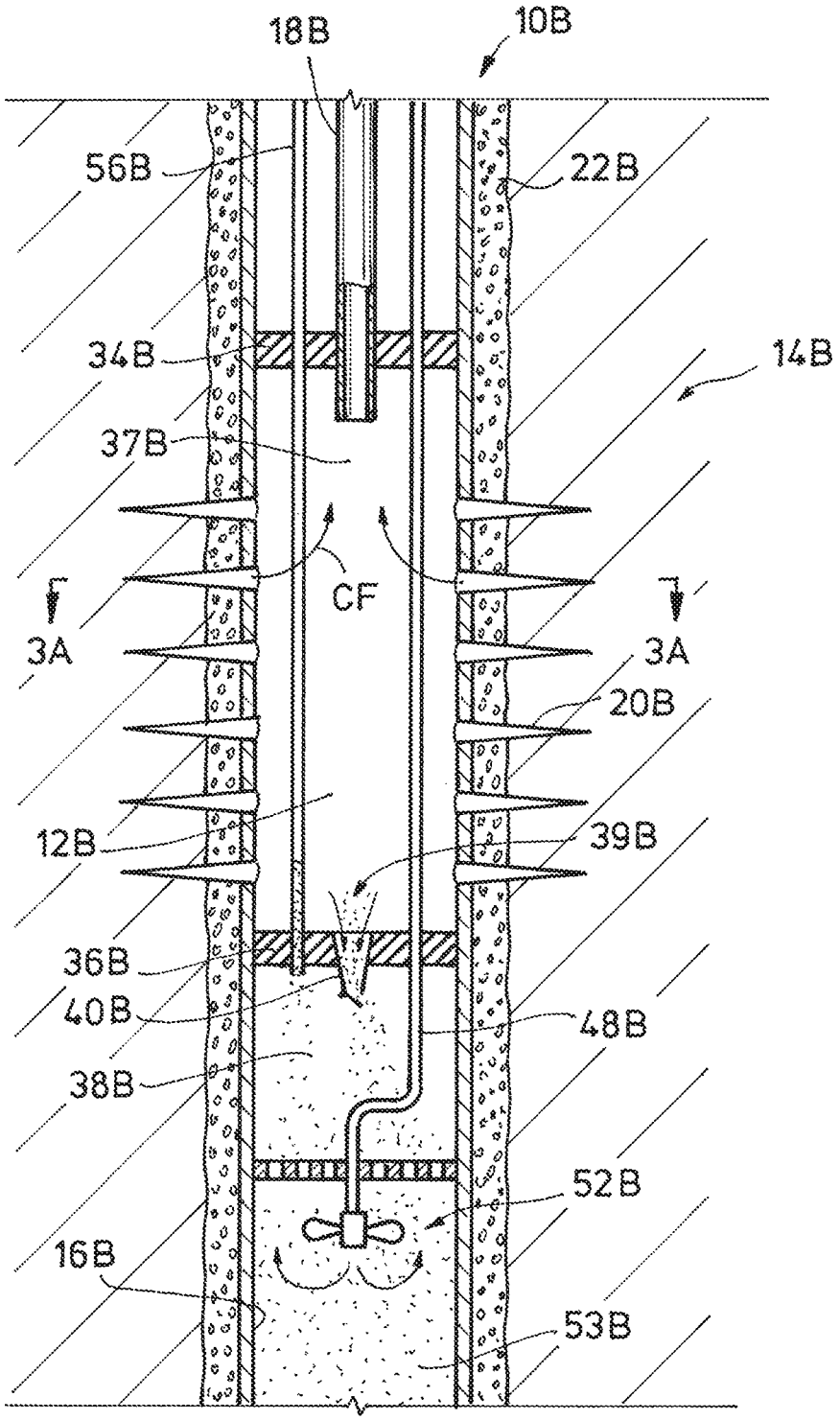
FIG. 3 is a side partial sectional view of an alternate example of a wellbore production system for producing fluids from a wellbore.

FIG. 3 shows in a side axial view one example of an alternate embodiment of a wellbore production system 10B where a lower end of production tubing 18B is open and has full communication with the production space 37B. Here, separation of sand 39B from motive fluid is accomplished without a dedicated separator. In one example, sand 39B is removed from the connate fluid CF by gravitational forces that draw the sand 39B from the connate fluid CF. One example of this is strategically forming perforations 20B that penetrate through casing 16B and into the surrounding formation 14B. As shown in an axial sectional view of FIG. 3A, perforations 20B are oriented along lines that are generally tangential with the outer circumference of wellbore 12B. As such, the flow of connate fluid $CF_T$ enters wellbore 12B a tangential path and adjacent the sidewalls of casing 16B. The resulting flow is generally rotational and follows a helical path inside wellbore 12B so that through gravity can separate out any particles, such as sand, that may be entrained within the connate fluid $CF_T$ being produced from formation 14B. Referring back to FIG. 3, the particles, such as sand 39B (FIG. 1) fall due to gravity towards an end of production space 37B proximate packer 36B, the sand 39B is then directed to the discharge chute 40B where it is directed to sealed space 38B through discharge chute 30B. Similar to the example of FIG. 1, motive fluid is delivered to sealed space 38B via an inlet line 48B where a slurry 53B is produced and injected into discharge line 56B for transport to outside of wellbore 12B.

Figure 4:
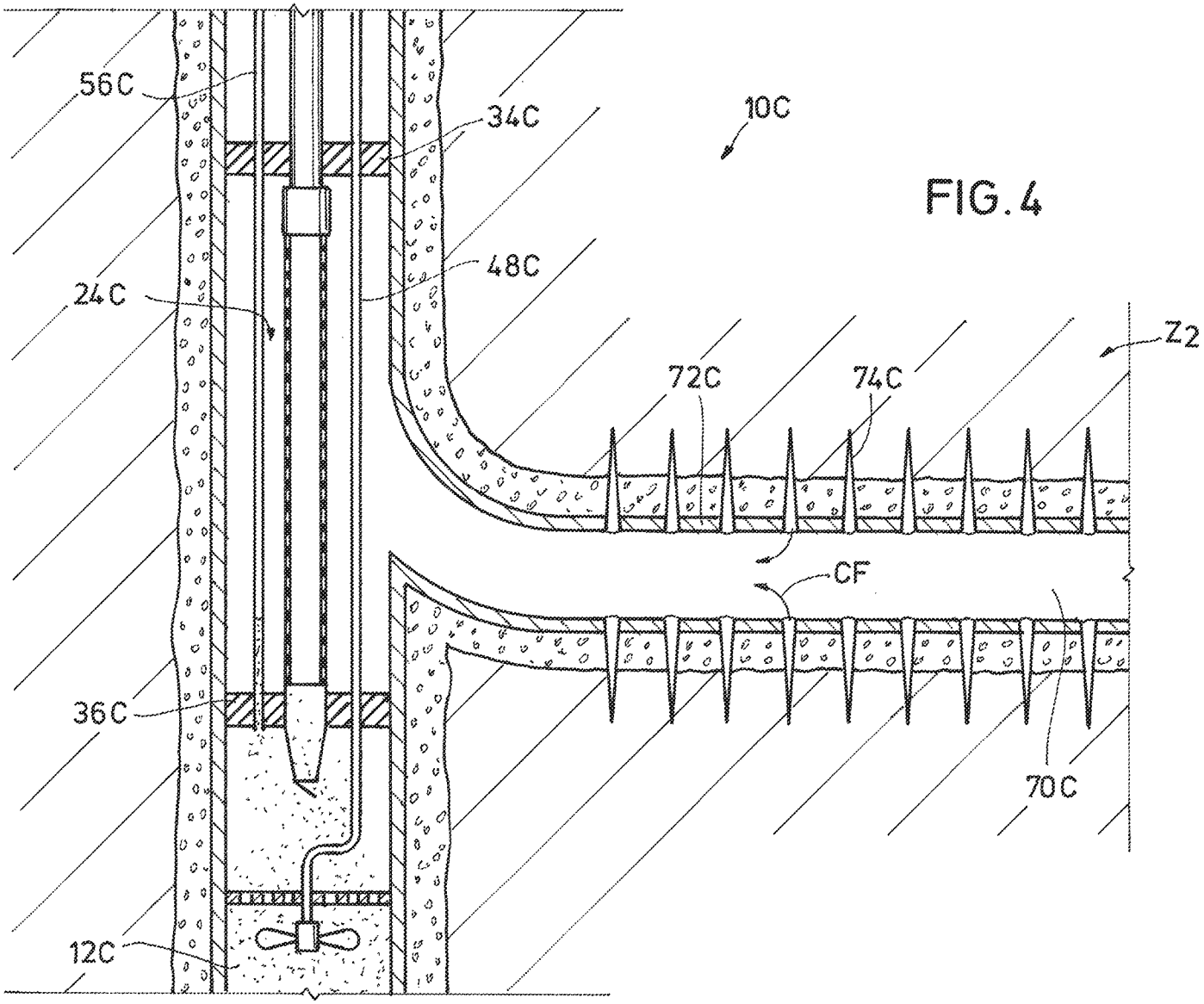
FIG. 4 is a side partial sectional view of an example of a wellbore production system for producing fluids from a wellbore, where the wellbore has a main bore and a lateral bore.

FIG. 4 shows in a side sectional view, an example of a wellbore production system 10C disposed in a wellbore 12C. Here wellbore 12C is intersected by a lateral bore 70C that extends generally oblique to wellbore 12C. In the example of FIG. 4, wellbore 12C defines a main bore. Further, separator 24C is shown adjacent the intersection of main bore 12C and lateral bore 70C, so that connate fluid CF produced from formation $Z_2$ adjacent lateral wellbore 70C can be directed to separator 24C to remove particulate matter, such as sand 39C, within the produced connate fluid CF in the methods above described. Further shown, casing 72C lines lateral wellbore 70C and which includes perforations 74C for allowing the flow of connate fluid CF in zone $Z_2$ to be produced into lateral wellbore 70C.

Figure 5:
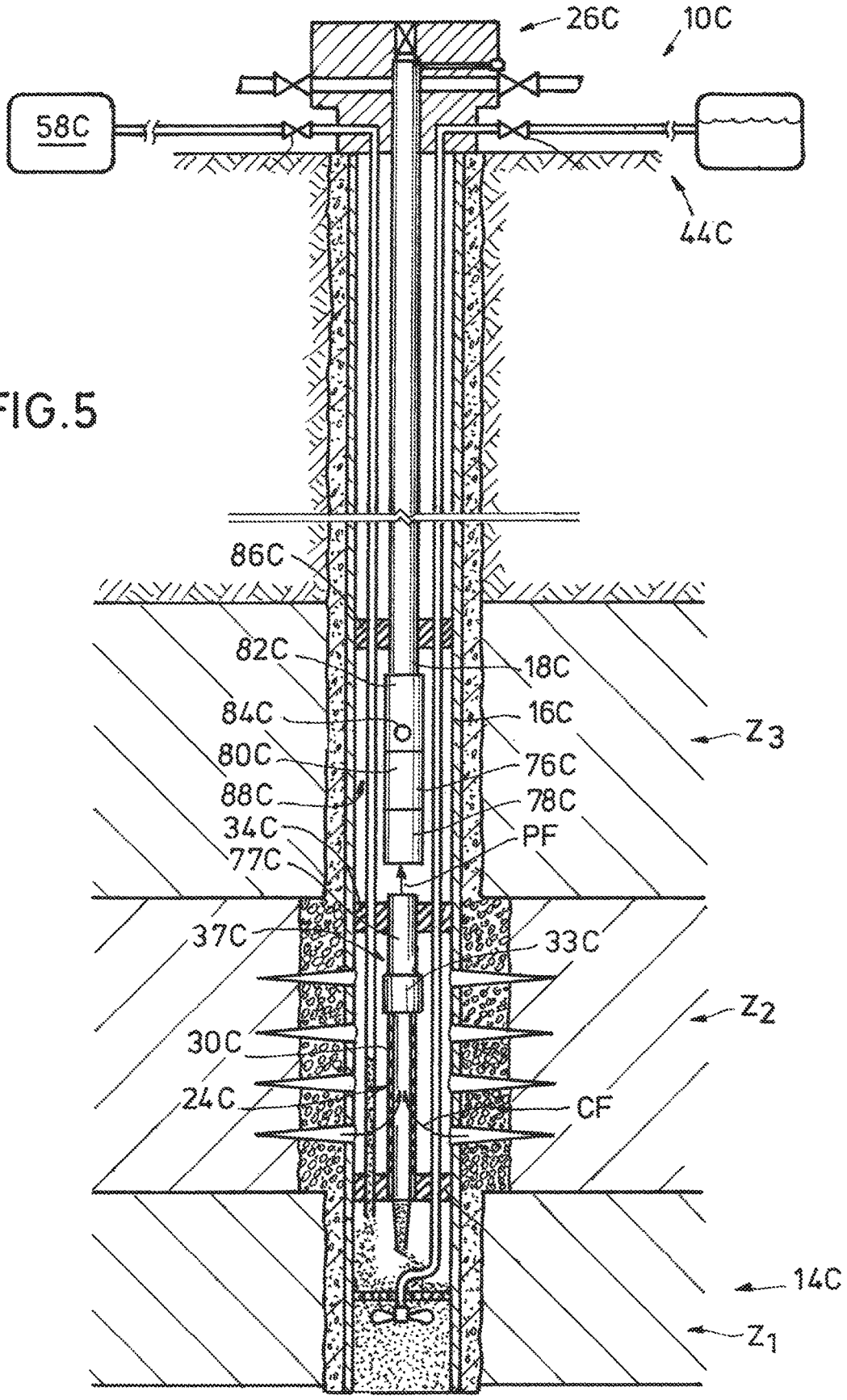
FIG. 5 is a side partial sectional view of an example of the wellbore production system of FIG. 1 and having an example of an artificial lift system.

Shown in a side sectional view in FIG. 5 is an alternate example of a wellbore production system 10C that includes an artificial lift system 76C. As described above, solids in the connate fluid CF are removed in the separator 24C, and directed to the storage tank 58C using the sand removal system 44C. With the solids being removed, the connate fluid CF is now referred to as production fluid PF, and shown exiting a discharge pipe 77C that connects to an end of screen hanger 33C opposite its connection to housing 30C. Artificial lift system 76C is shown coupled to a lower terminal end of tubing 18C and includes a motor section 78C, seal section 80C, and pump section 82C. The production fluid PF enters the artificial lift system 76C through an inlet 84C shown on the pump section 82C. A packer 86C set in the annulus 88C between the production tubing 18C and inner surface of casing 16C defines a barrier in the annulus 88C that forces the fluid PF into inlet 84C. Other than the modifications for inclusion of the artificial lift system 76C, the system 10C of FIG. 5 is largely the same as the system 10 of FIG. 1.

Examples exist where the artificial lift system 76C is an electrical submersible pump having a series of impellers and diffusers (not shown) for pressurizing liquids entering the artificial lift system 76C. Optionally the artificial lift system 76C can be a progressive cavity pump, rod pump, or any type of system for pressurizing fluid downhole. Fluid pressurized in the artificial lift system 76C is directed into production tubing 18C and directed to wellhead assembly 26C. Artificial lift systems are vulnerable to erosion and clogging when handling fluid with sand and other particulate matter entrained within. Thus a significant advantage is provided by combining sand removal equipment with an artificial lift system so that sand can be effectively removed from the fluid before reaching the artificial lift system. Thus reducing downtime of an artificial lift system increases production efficiency.

Figure 6:
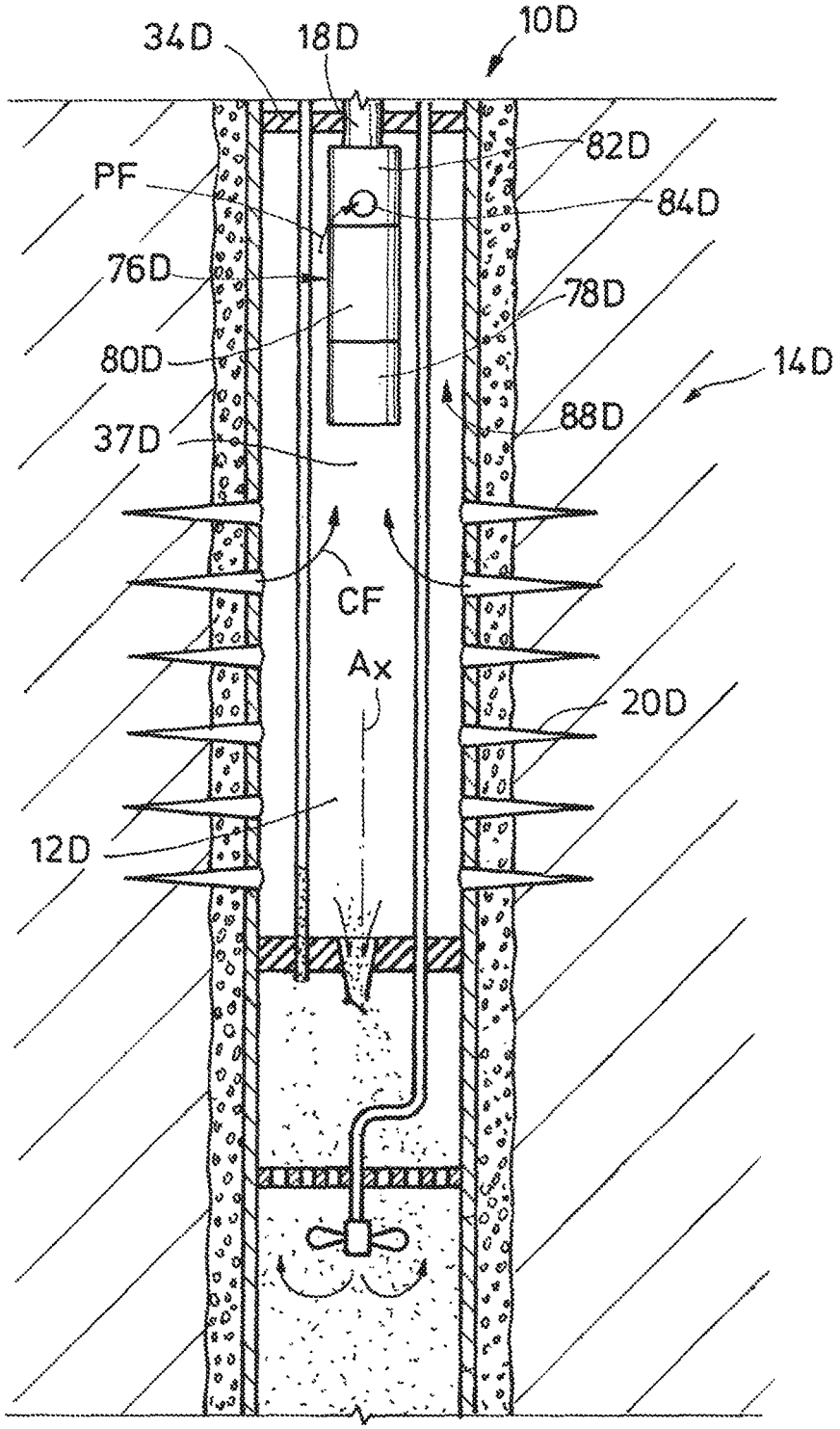
FIG. 6 is a side partial sectional view of an example of the wellbore production system of FIG. 3 and having an example of an artificial lift system.

FIG. 6 is a side sectional view of an alternate example of the wellbore production system 10D where an example of an artificial lift system 76D is shown mounted onto a lower terminal end of production tubing 18D. In this example artificial lift system 76D includes a motor section 78D, seal section 80D, and pump section 82D. An inlet 84D on the pump section 82D provides communication between fluid in the production space 37D and without a separator for separating sand or other particulates from the fluid. Like the perforations 20B of FIG. 3, perforations 20D are oblique to a radius of wellbore 12D, which as described above, creates a helical flow pattern of the connate fluid CF in the wellbore 12D that separates solid particulates from the connate fluid CF to form production fluid PF. As shown, the production fluid PF flows towards artificial lift system 76D. Packer 34D in annulus 88D blocks flow of the production fluid PF upward past the artificial lift system 76D. Embodiments of the artificial lift system 76D include a centrifugal pumping system, a progressive cavity pump, rod pump, or any type of system for moving fluid from a wellbore. The sand removal hardware illustrated in the example of FIG. 6 is largely the same as that depicted in FIG. 3.

Figure 7:
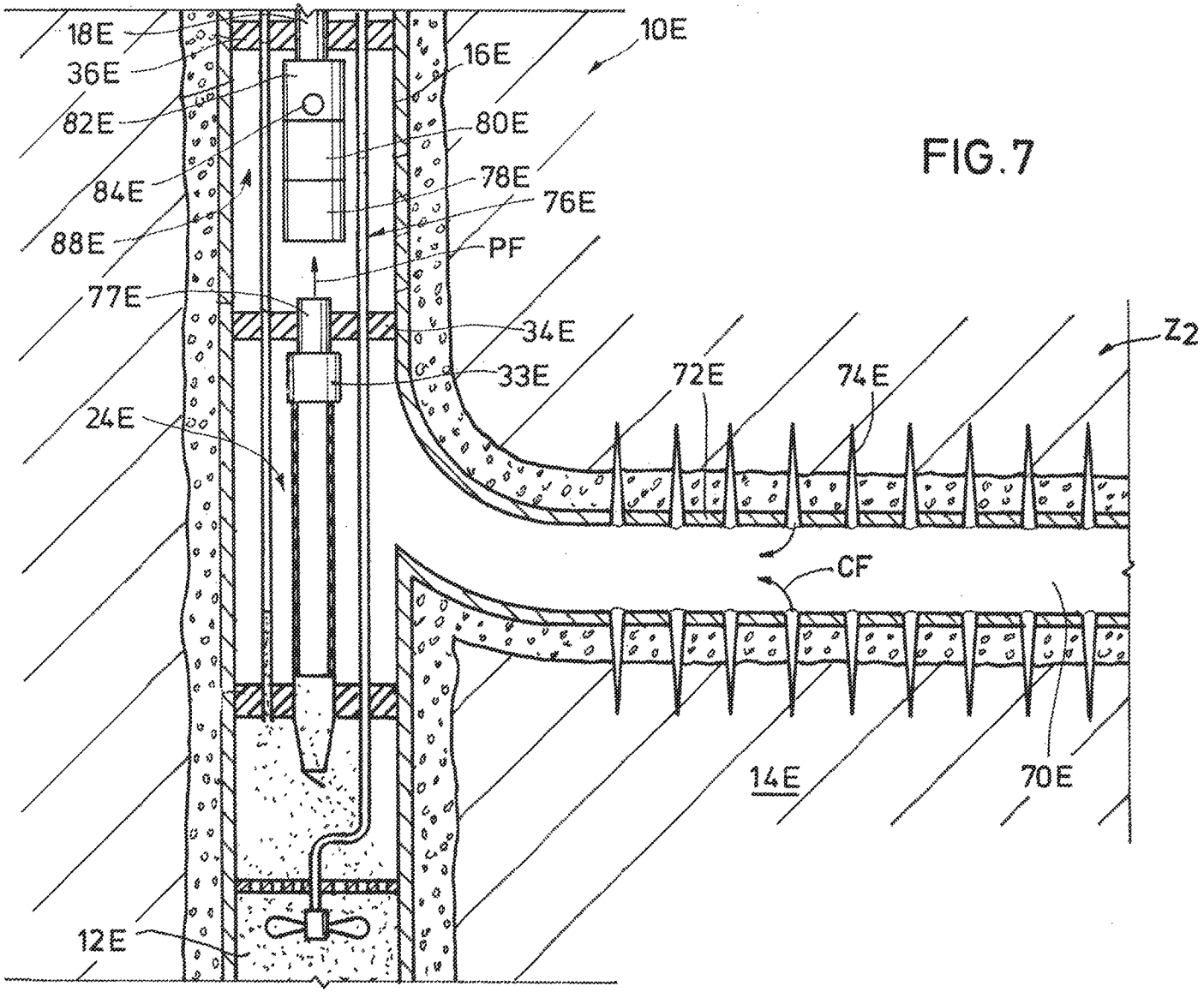
FIG. 7 is a side partial sectional view of an example of the wellbore production system of FIG. 4 and having an example of an artificial lift system.

Another alternate example of a wellbore production system 10E is provided in side sectional view in FIG. 7. In this example the wellbore production system 10E includes an artificial lift system 76E which mounts to a lower terminal end of production tubing 18E. In this example, connate fluid CF flows from the formation 14E into the lateral bore 70E via perforations 74E that penetrate the casing 72E and extend into the formation 14E. The connate fluid CF flows from the lateral bore 70E into the main bore 12E and into separator 24E where solids and other particulate matter are removed by centrifugal action. The fluid after having the solids removed is referred to as production fluid PF, and which exits the separator 24E via a discharge pipe 77E. Artificial lift system 76E of FIG. 7 includes a motor section 78E, seal section 80E, and pump section 82E. The production fluid PF enters the artificial lift system 76E through an inlet 84E shown on the pump section 82E. A packer 34E set in the annulus 88E between the artificial lift system 76E and inner surface of casing 16E defines a barrier in the annulus 88E and forces the fluid PF into inlet 84E. Other than the modifications for inclusion of the artificial lift system 76E, the system 10E of FIG. 7 is largely the same as the system 10C of FIG. 4.

Packer 36E is disposed around tubing 18E above artificial lift system 76E. Screen hanger 33E couples to a lower end of discharge pipe 77E and provides a support for housing 24E, which depends from hanger 33E and on an end opposite from artificial lift system 76E. Similar to artificial lift system 76C of FIG. 5, artificial lift systems 76D, 76E can be a centrifugal electrical submersible pump, a progressive cavity pump, a rod pump, or any other known or later developed means for pressurizing fluid for delivery to surface.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for producing from a wellbore comprising:
- production tubing in the wellbore having an inlet in fluid communication with a formation that is intersected by the wellbore;
- upper and lower seals axially spaced apart from one another and in an annulus that is bounded by walls of the wellbore;
- a sealed space on a side of the lower seal opposite the upper seal;
- a discharge chute that is in communication with a source of sand, that that has an exit disposed in the sealed space;
- an inlet line in communication with a source of fluid and having a fluid exit in the sealed space; and
- a discharge line having an inlet in the sealed space, so that when fluid from the source of fluid flows out of the fluid exit and into the sealed space, sand from the source of sand in the sealed space mixes with the fluid exiting the fluid exit and is forced into the inlet of the discharge line.

2. The system of claim 1, wherein the source of sand comprises a separator coupled with the production tubing, and that comprises a housing connected to the discharge chute, inlet ports formed in a sidewall of the housing.

3. The system of claim 2, further comprising a one way valve on an end of the discharge chute distal from the housing which is in an open configuration when pressure in the discharge chute is greater than pressure in the sealed space, and which is in a closed configuration when pressure in the sealed space is greater than pressure in the discharge chute.

4. The system of claim 1, further comprising a perturbation element disposed in the sealed space for mixing the sand and the fluid.

5. The system of claim 4, wherein the perturbation element mounts to the inlet line, and which comprises a base that selectively rotates and that is in fluid communication with the inlet line, vanes formed on the base, and blades mounted to the base, so that when fluid from the inlet line flows across the base, interaction of the fluid with the vanes causes the base and blades to rotate, thereby mixing the sand with the fluid to create a slurry.

6. The system of claim 1, further comprising a wellhead assembly mounted at an opening of the wellbore on the Earth's surface.

7. The system of claim 6, wherein the inlet line and discharge lines are routed through the wellhead assembly.

8. The system of claim 1, wherein the wellbore comprises a main bore, and a lateral bore is oriented oblique to the main bore, and that intersects the main bore on a side of the seal opposite from the sealed space, and wherein the lateral bore comprises the source of the sand.

9. The system of claim 1, wherein perforations are formed in the formation and that are tangential to sidewalls of the wellbore, and wherein the formation comprises the source of the sand.

10. The system of claim 1, wherein a production space is defined in a portion of the wellbore between the upper and lower seals.

11. A system for producing from a wellbore comprising:

a means for transporting connate fluid from within the wellbore that is produced from a formation intersected by the wellbore;

a means for forming a slurry of motive fluid and sand separated from the connate fluid that comprises a selectively rotatable perturbation element; and a means for transporting the slurry out of the wellbore.

12. The system of claim 11, wherein the means for transporting connate fluid from the wellbore comprises production tubing, and the means for separating sand from the connate fluid comprises a separator that attaches to the production tubing.

13. The system of claim 11, wherein the selectively rotatable perturbation element comprises blades that project radially from a base, a bore in the base in communication with a source of motive fluid, and vanes projecting from a sidewall of the bore that extend along helical paths.

14. The system of claim 13, wherein the perturbation element is selectively rotated by contacting the perturbation element with the motive fluid.

15. The system of claim 11, wherein the means for transporting the slurry out of the wellbore comprises a source of the motive fluid, an inlet line in the wellbore having an inlet in fluid communication with a source of the motive fluid and a fluid exit proximate a sealed space in the wellbore where sand separated from the connate fluid is collected, and a discharge line having an inlet in fluid communication with the slurry in the sealed space, and an exit that is disposed outside of the wellbore, and wherein the source of the motive fluid is at a pressure sufficient to lift the slurry from the sealed space and to outside of the wellbore.

16. The system of claim 11, further comprising a means for separating the sand from the connate fluid.

17. A method of producing from a wellbore comprising:

transporting connate fluid from the wellbore that is produced from a production zone that surrounds a portion of the wellbore; and forming a slurry by combining the particulate matter with a motive fluid injected into the wellbore, and using the motive fluid to rotate a perturbation element, so that a pressure of the motive fluid lifts particulate matter separated from the connate fluid to outside of the wellbore.

18. The method of claim 17, wherein a seal blocks axial flow in the wellbore at a depth past the production zone to define a sealed space on a side opposite the production zone.

19. The method of claim 18, wherein the slurry is mixed in the sealed space in the wellbore and separate from where connate fluid enters the wellbore from the production zone.

20. The method of claim 18, wherein the perturbation element comprises a base and blades.

* * * * *